US005828008A

United States Patent [19]

Lockwood et al.

[11] Patent Number: 5,828,008

[45] Date of Patent: Oct. 27, 1998

[54] FASTENER ASSEMBLY FOR ESTABLISHING A MECHANICAL AND ELECTRICAL CONNECTION TO COATED METAL

[75] Inventors: Mark D. Lockwood; Mark J. Friederick, both of Dubuque, Iowa

[73] Assignee: Barnstead/Thermolyne, Dubuque, Iowa

[21] Appl. No.: 796,509

[22] Filed: Feb. 6, 1997

[51] Int. Cl.[6] ..... H01B 17/00

[52] U.S. Cl. ..... 174/138 R; 411/155

[58] Field of Search ..... 174/88 B, 99 R, 174/137 R, 138 R; 411/155, 156

[56] References Cited

U.S. PATENT DOCUMENTS

| | | | |
|---|---|---|---|
| 1,245,253 | 3/1917 | Cory . | |
| 1,351,676 | 8/1920 | Myers . | |
| 1,801,999 | 4/1931 | Bowman | 411/156 |
| 1,946,713 | 12/1934 | Rowley . | |
| 1,994,251 | 3/1935 | Mueller . | |
| 2,270,807 | 1/1942 | Johnson . | |
| 2,297,261 | 9/1942 | Thode . | |
| 2,297,957 | 10/1942 | Hanneman | 411/155 |
| 2,423,290 | 7/1947 | Bonwitt . | |
| 2,518,399 | 8/1950 | Thompson . | |
| 2,946,039 | 7/1960 | Grunwald et al. . | |
| 3,181,584 | 5/1965 | Borowsky | 411/155 |
| 3,315,720 | 4/1967 | Gutshall | 411/156 |
| 3,340,494 | 9/1967 | Gutshall . | |
| 3,486,158 | 12/1969 | Soltysik et al. . | |
| 3,509,521 | 4/1970 | Gutshall . | |
| 3,719,919 | 3/1973 | Tibolla . | |
| 3,761,867 | 9/1973 | Churla . | |
| 3,828,493 | 8/1974 | Vezmar | 52/1 |
| 3,910,663 | 10/1975 | Winger . | |
| 3,914,001 | 10/1975 | Nelson et al. . | |
| 3,967,083 | 6/1976 | Bould et al. | 200/237 |
| 3,967,875 | 7/1976 | Stanaitis . | |
| 4,023,882 | 5/1977 | Pettersson . | |
| 4,157,725 | 6/1979 | Stanaitis . | |
| 4,222,626 | 9/1980 | Hollyday et al. . | |
| 4,440,463 | 4/1984 | Gliha et al. . | |
| 4,589,715 | 5/1986 | Welsenburger . | |
| 4,657,459 | 4/1987 | Landt . | |
| 4,775,337 | 10/1988 | Van Wagener et al. . | |
| 4,808,050 | 2/1989 | Landt . | |
| 4,842,463 | 6/1989 | Landt . | |
| 4,904,193 | 2/1990 | Graves . | |
| 4,929,801 | 5/1990 | Hibbert | 174/16.2 |
| 5,041,014 | 8/1991 | Shimizu et al. . | |
| 5,056,975 | 10/1991 | Ando | 411/155 |
| 5,207,535 | 5/1993 | Saab . | |
| 5,207,588 | 5/1993 | Ladoceur et al. . | |
| 5,441,417 | 8/1995 | Ladoceur et al. . | |
| 5,453,027 | 9/1995 | Buell et al. . | |
| 5,487,685 | 1/1996 | Stillback et al. . | |

*Primary Examiner*—Kristine L. Kincaid
*Assistant Examiner*—Dhiru R. Patel
*Attorney, Agent, or Firm*—Wood, Herron & Evans, L.L.P.

[57] ABSTRACT

An electrically operated device and fastener assembly for establishing an electrical and mechanical connection on the device. The fastener assembly generally includes a fastener and a washer which may be permanently flattened against the device to establish an electrical connection to a piece of coated metal. Upon removal of the fastener, the washer remains permanently flattened against the device or piece of metal and mechanically connected thereto by a build-up of coating material on projections associated with the washer. Fastener assemblies may be constructed using, for example, sheet metal screws requiring only one of the washers in the assembly or machine screws which may require two of the washers.

11 Claims, 3 Drawing Sheets

FASTENER ASSEMBLY FOR ESTABLISHING A MECHANICAL AND ELECTRICAL CONNECTION TO COATED METAL

BACKGROUND OF THE INVENTION

The present invention generally relates to fastener assemblies and, more specifically, to connections involving insulative coated metal that still allow for electrical conduction through the metal.

Two sheets of metal are often connected together with sheet metal screws or other types of fasteners in order to mechanically secure the two sheets together. Often it is desirous to electrically connect the two sheets of metal together to form an electrical pathway therebetween in order to electrically ground both sheets. Provided the sheets of metal are not painted and do not have some other insulation layer covering them, the metal-to-metal contact between the sheets and the fasteners connecting them will establish an electrical connection between the sheets. This facilitates the ability to ground the entire assembly.

When one or both sheets are coated with either a wet coat paint or a powder coat paint, the layer of paint covering the sheets often acts as an electrical insulator eliminating the electrical connection between the sheets. Therefore, either penetration of the coating or some other avoidance of the coating by the fastener assembly is required to maintain electrical conduction between the sheets and the fastener assembly. One may mask those areas of the sheet metal adjacent fastener holes before coating the sheet or scrape off the coating to facilitate metal to metal contact. These options, however, are time consuming and costly.

The preferred manner of establishing electrical conduction between a metal fastener assembly and a coated piece of metal has been to penetrate the coating with part of the fastener assembly during the assembly process. This penetration may be accomplished through the use of a washer adapted to penetrate through a layer of insulating material upon tightening of an associated fastener. If the fastener is a sheet metal screw, tightening the sheet metal screw causes the threads of the screw to contact the edges of a hole in one of the sheets of metal and projections on a washer to penetrate through the layer of insulation and contact the metal of the other sheet thereby creating an electrical pathway between the sheets. These washers may have a plurality of relatively sharp projections on one or both surfaces to penetrate through the paint or insulation layer of the sheet.

Some of the simplest forms of washers usable for the purpose of penetrating or coating have been conventional toothed spring washers, such as those sold by Shakeproof Corp. Such washers are concavely shaped and, upon tightening of the fastener assembly, the washer slightly compresses and the teeth scrape into the coating in an attempt to contact the underlying metal. However, penetration by the teeth completely through the coating to the underlying metal is often insufficient to establish grounding, especially with thicker paints such as powder coat paints. Also, upon removal of the fastener the washer springs back away from the sheet and tends to fall off. This makes disassembly and maintenance much more troublesome, especially when numerous fasteners must be removed during the process.

Another washer used in the past is referred to as an external tooth lock washer, also available from Shakeproof Corp. This washer is essentially flat but has peripheral teeth oriented downward to lock onto a surface upon tightening of a fastening assembly. These washers have only been partially successful in establishing an electrical connection with coated metal. The main problem has been their inability to displace enough of the coating to achieve contact between the teeth and the underlying metal, especially when using powder coat paints. These washers also generally fall off during disassembly. That is, they fail to make an independent mechanical connection to the coated surface.

It would therefore be desirable to provide a fastener assembly and process utilizing a fastener and a toothed washer wherein the teeth of the washer consistently contact metal underlying even relatively thick coatings. It would also be desirable to provide such a washer that remains mechanically affixed to the coated piece of metal upon the removal of the fastener.

SUMMARY OF THE INVENTION

The present invention provides a fastener assembly for reliably establishing an electrical pathway between the fastener assembly and a coated piece of metal and, in addition, maintains a mechanical connection between the coated piece of metal and a washer associated with the fastener assembly upon removal of the fastener portion of the assembly. Specifically, the invention pertains to any electrically operated device which requires grounding during operation. In its broadest form, therefore, this device would comprise at least one piece of metal coated with an electrically insulative coating and a fastener assembly for establishing an electrical connection and, preferably, both a mechanical and electrical connection to the piece of metal.

The fastener assembly includes a fastener engageable with a piece of metal to establish a mechanical connection therewith and further includes at least one washer disposed between at least a portion of the fastener and the piece of metal. The washer includes a generally concave side and has a plurality of projections on the generally concave side. The washer is compressible between the fastener and the piece of metal. During this compression, the washer is permanently flattened and the projections are urged downwardly into the coating and in a radially outward direction. The ability of the washer to completely flatten during the assembly process significantly improves contact of the projections with the underlying piece of metal.

According to one aspect of the invention, a build-up of coating material forms on the projections such that, upon removal of the fastener, the washer remains flattened and mechanically connected against the piece of metal by the built up coating material. To maintain the flattened condition of the washer even after removal of the fastener, the washer is formed of a permanently deformable metal. The metal may be slightly hardened as long as the hardening does not interfere with the ability of the washer to be permanently flattened. For example, the projections of the washer may be hardened to improve the cutting action without significantly hardening the rest of the washer.

In one preferred embodiment, the fastener is a threaded fastener having a head portion that engages the convex side of the washer and pushes the washer flat against the piece of coated metal during tightening of the fastener assembly. The fastener may, for example, be either a sheet metal screw, a machine screw, or a bolt. In the case of a sheet metal screw attaching two coated pieces of sheet metal together, an electrical pathway is formed between the first piece of sheet metal and the second piece of sheet metal respectively through the washer, the head of the screw, and the threads of the screw which are in contact with the second piece of sheet metal. In the case of a machine screw or a bolt, a nut may be used to secure two pieces of metal together with a washer of the present invention disposed between the head of the screw and the first piece of metal and another washer of the present invention disposed between the nut and the second piece of metal when the second piece of metal is also coated with an electrically insulative coating.

A method of the present invention includes inserting the fastener through a washer constructed generally as disclosed above with the generally concave side of the washer facing a coated side of the piece of metal. The fastener is then used to permanently flatten the washer against the piece of metal to cause the projections to penetrate the coating and contact the piece of metal underneath. In accordance with the advantages of this invention, the fastener is removed and the washer remains permanently flattened against the piece of metal and mechanically connected to the piece of metal by a build-up of coating formed on the projections.

From the above description, several objectives and advantages of this invention will be apparent. Among these, a fastener assembly constructed in accordance with this invention provides both a mechanical and electrical connection between the fastener assembly and one or more pieces of coated metal, such as sheet metal which has been painted using either a wet coat paint or a powder coat paint. Upon removal of the fastener, the permanently flattened washer or washers associated with the fastener assembly remain attached to the coated pieces of metal. This not only makes assembly and disassembly easier, such as during maintenance operations, but provides a visual indication of grounding. That is, if the washer is flattened against the piece of coated metal, a grounding pathway has been established.

These and other objectives and advantages of the present invention will be more readily understood upon review of the following detailed description of the preferred embodiments taken in conjunction with the accompanying drawings.

DETAILED DESCRIPTION OF THE PREFERRED EMBODIMENTS

Figure 1:
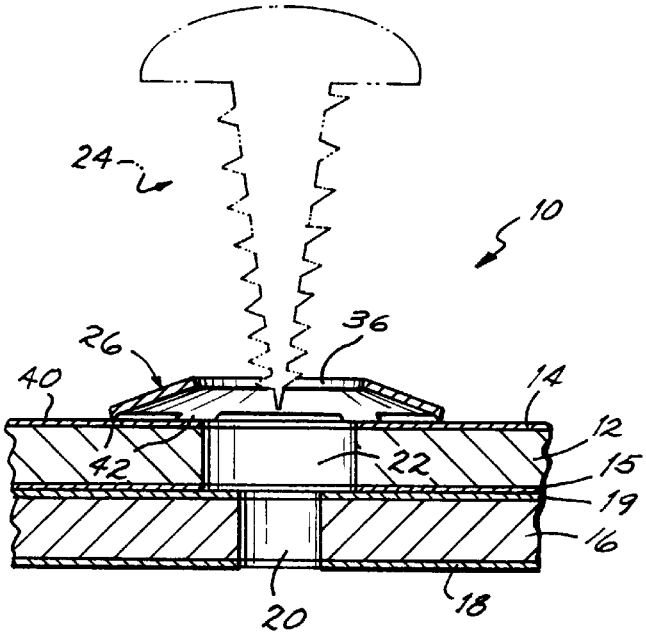
FIG. 1 is a cross-sectional view of the fastening assembly of the present invention utilizing a sheet metal screw as a fastener prior to assembly.

Referring to the drawings, and particularly to FIG. 1, there is illustrated the fastening assembly 10 of the present invention. The fastening assembly 10 is used to mechanically and electrically connect a first sheet of metal 12 having a coating or layer of insulating material 14 on top of the sheet and a coating or layer of insulating material 15 below the sheet and a second sheet of metal 16 beneath the first sheet 12. The second sheet 16 is illustrated as having a coating 18 of insulating material below the second sheet and a coating 19 of insulating material on top of the second sheet. This layer of insulating material is most commonly a coating of paint but may be any other type of electrically insulating coating. However, the second sheet 16 need not be coated with an insulating material. The second sheet 16 has at least one hole 20 therein which is aligned with at least one hole 22 in the first sheet 12, the hole 22 of the first sheet 12 being of greater diameter than the hole 20 in the second sheet.

Figure 2:
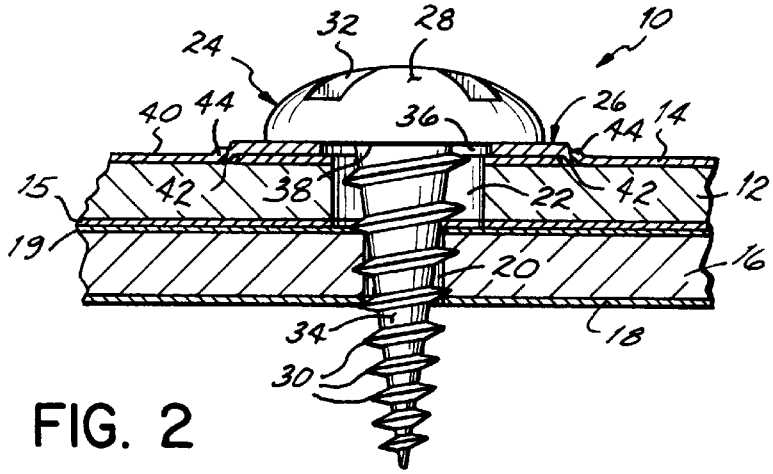
FIG. 2 is a cross-sectional view of the fastening assembly of FIG. 1 electrically and mechanically connecting two sheets of metal after assembly.

In its simplest form the fastening assembly 10 comprises a fastener 24 and a washer 26 constructed in accordance with the invention. The fastener 24 may be any number of items including screws and bolts as long as the fastener is engageable with and capable of being tightened against the washer 26. In the preferred embodiment, the fastener 24 has a head 28 at one end and a plurality of threads 30 on the other end of the fastener 24. The heads 28 of the fasteners illustrated are shown having a cross 32 (see FIG. 2) corresponding to and for the insertion of the end of a Phillips screwdriver in order to turn the fastener 24. However, a cross is not necessary; a slot may alternatively be placed in the heads of the fasteners 24. The fastener 24 illustrated in FIGS. 1 and 2 is a sheet metal screw having a conical body 34 which has wrapped around it a plurality of threads 30. The washer 26 of the fastener assembly is generally concavely shaped and has a hole 36 therein, the hole 36 of the washer being aligned with the holes 22, 20 of the first and second sheets respectfully. The concavely shaped washer is placed on top of the aligned holes 20, 22 so the washer protrudes above the upper surface of the first sheet 12.

In order to secure the sheets together, the fastener 24 is rotated and pushed downwardly with a screwdriver or other tool so that the fastener passes through the hole 36 in the washer, the hole 22 in the first sheet 12 and partially into the hole 20 of the second sheet 16. The diameter of the hole 22 in the first or upper sheet 12 is greater than the diameter of the threads 30 of the fastener 24 so the fastener 24 may pass therethrough without any need to rotate the fastener 24. The diameter of the hole 20 in the second sheet 16 is such that only part of the length of the screw body 34 may pass therethrough without rotating the head 28 of the fastener 24. A screwdriver is then inserted into the cross 32 of the head 28 of the fastener 24 and rotated causing the threads 30 of the fastener 24 to cut into the metal of the second sheet 16 proximate the hole 20 in the second sheet 16. The washer 26 is pushed downwardly between the lower edge 38 of the fastener head 28 and the upper surface 40 of the first sheet 12. As the washer 26 is flattened a plurality of projections 42 around the periphery of the washer (see FIGS. 5, 5A) are pushed generally downwardly and radially outward through the layer 14 of insulating material and against the metal of the first sheet 12, establishing metal-to-metal contact between the projections 42 of the washer 26 and the metal of first sheet 12.

As illustrated in FIG. 2, a build-up of insulating material 44 forms over the outside of the projections 42 of the washer 26 due to the projections being pushed downwardly and outwardly upon the flattening of the washer 26. The metal-to-metal contact between the projections 42 of the washer 26 and the metal of the first sheet 12 establishes an electrical connection between the first sheet 12 and the washer 26. Because the threads 30 of the fastener 24 contact the metal of the second sheet 16, an electrical circuit is created from the second sheet 16 through the fastener 24 to the washer 26 and through the projections 42 of the washer 26 to the first sheet 12. Through this circuit the second sheet 16 is electrically connected to the first sheet 12 and grounding of the sheets is possible.

Figure 2A:
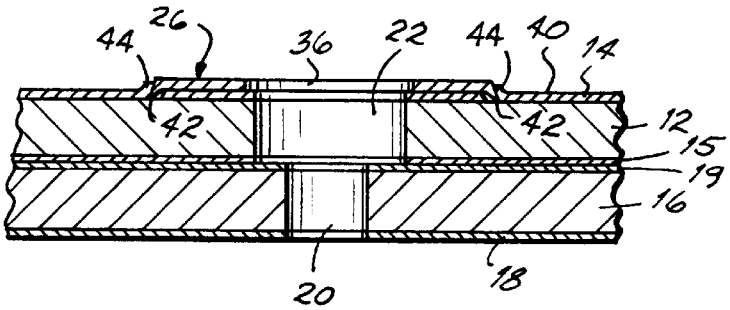
FIG. 2A is a cross-sectional view of two coated sheets of metal having the washer of FIG. 5 embedded in the upper sheet after removal of the fastener.

FIG. 2A illustrates the washer of the present invention upon removal of the fastener in FIG. 2. The washer 26, upon removal of the fastener 24 remains permanently flattened against the insulation 14 of the upper sheet of metal 12 due to the mechanical connection between the projections of the washer and the insulation layer 14 of the sheet metal. Because the washer 26 is made of a permanently deformable metal, the washer 26 does not spring back to its original form and separate from the sheets of metal upon the removal of the fastener 24, but rather remains flattened once the fastener 24 is removed. This feature of the present invention allows one or more fasteners to be removed without the washers falling off the metal and being lost or displaced. Therefore, a user may remove the fasteners 24 in order to separate the two sheets 12, 16 of metal temporarily but then quickly and easily put the sheets 12, 16 of metal together the way they were without losing the washers 26.

Figure 3:
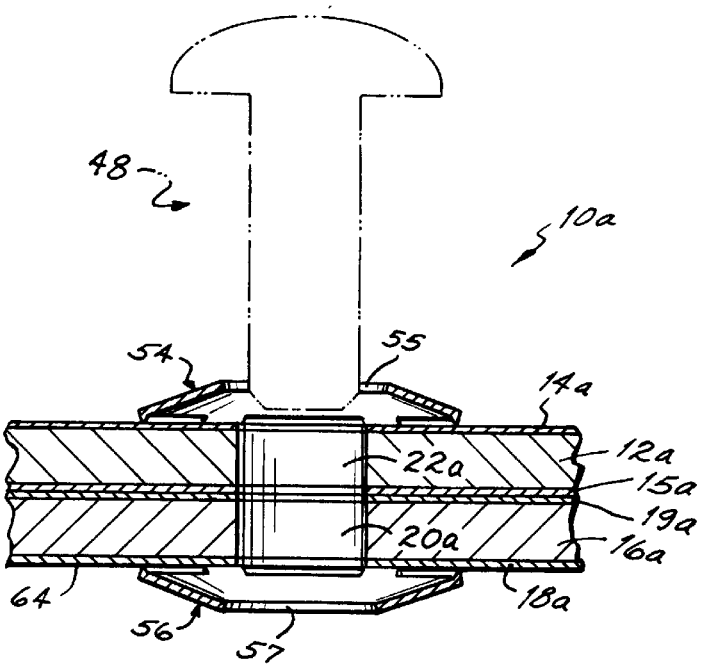
FIG. 3 is a cross-sectional view prior to assembly of a fastener assembly comprising a machine screw, two washers and a nut.
Figure 4:
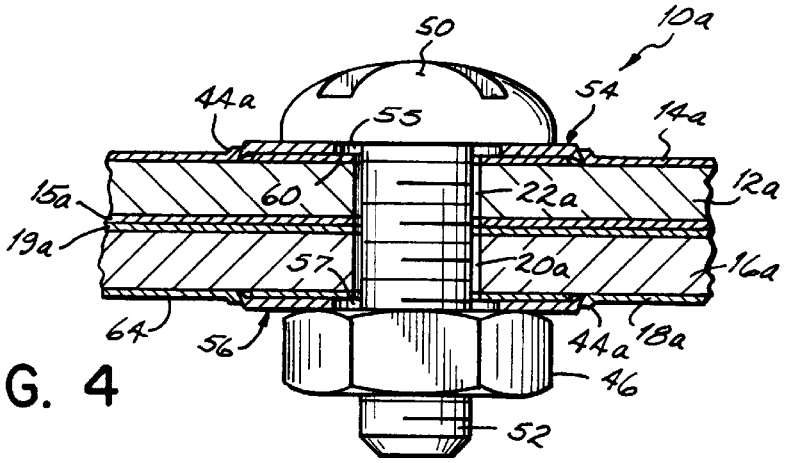
FIG. 4 is across-sectional view of a fastening assembly of FIG. 3 after assembly.

FIGS. 3 and 4 illustrate an alternative fastening assembly used to connect two sheets of metal together, one sheet being on top of the other. The primary difference between this fastening assembly and the fastening assembly of FIGS. 1 and 2 is that a machine screw is used as the fastener 48. In addition, a second washer 56 and a nut 46 are utilized to hold the machine screw in place and the sheets 12*a*, 16*a* together. In place of a machine screw a bolt having threads on the lower end thereof may be used as part of this fastening assembly. Specifically, the fastening assembly 10*a* of this embodiment comprises a fastener 48 which may be a bolt or machine screw having a head 50 at one end and a plurality of threads 52 at the other end thereof. The threads 52 are adapted to receive a nut 46 which has hole therethrough (not shown) the hole having threads on the inner surface thereof. The fastening assembly 10*a* utilizes two washers 54, 56 of the same type described hereinabove rather than just one washer as used in the embodiment of FIGS. 1 and 2. Both washers are concavely shaped, have a hole therein and have the plurality of projections around the edge thereof. The first of the two washers 54 is aligned with the hole 55 of the washer 54 over the top of the holes 20*a*, 22*a* in the two sheets, the washer 54 being between the head 50 of the fastener 48 and top insulating layer 14*a* of the upper sheet of metal 12*a*. The second washer 56 likewise has a hole 57 therein and is placed directly underneath the aligned holes 22*a*, 20*a* in the first and second sheets respectively.

In use, the fastener 48 is inserted through the hole 55 in the first washer 54, through the aligned holes 22*a*, 20*a* in the sheets of metal and through the hole 57 in the second or bottom washer 56 while the washers are held in place. The nut 46 is then threaded onto the lower threaded portion 52 of the fastener 48 and the screw head or nut rotated relative to the other so that the upper washer is flattened between the lower surface 60 of the head 50 and the upper layer of insulation 14*a* of the first sheet 12*a* and the second washer 56 is flattened between the upper surface of the nut and the lower surface 64 of the second sheet 16*a*. Upon the tightening of the fastener 48 the washers 54, 56 flatten causing the projections of the washers to pass through the insulation layers 14*a*, 18*a* and establish a metal-to-metal contact between the projections of the washer and the metal interior of the sheets 12*a*, 16*a*. Therefore, even though the threads of the fastener do not dig into the metal as in the sheet metal screw of the first embodiment (FIGS. 1 and 2) a metal-to-metal grounding contact is established between the sheets through the fastener and both washers.

Figure 4A:
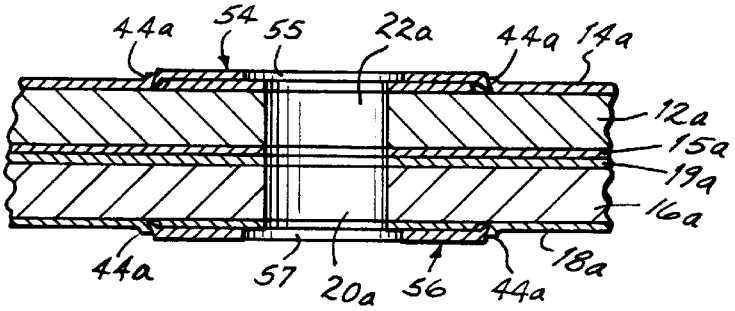
FIG. 4A is a cross-sectional view of two coated sheets of metal having the washers of FIG. 5 (from alternative embodiment in FIGS. 3 and 4) embedded in the upper and lower sheets after removal of the fastener.

FIG. 4A illustrates two of the washers 54, 56 of the present invention upon removal of the fastener 48 in FIG. 4. The washers, 54, 56 upon removal of the fastener 48 remain flattened against the insulation 14*a* and 18*a* of the upper and lower sheets of metal 12*a* and 16*a*, respectively. The washers 54, 56 both have the same mechanical characteristics as the washer 26 which was described earlier regarding FIGS. 1, 2, and 2A.

Figure 5:
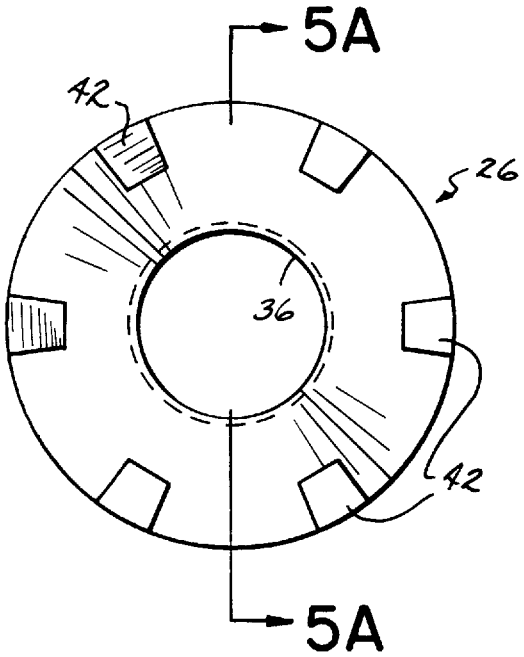
Fig. 5 is a bottom view of the washer of the fastening assembly.
Figure 5A:
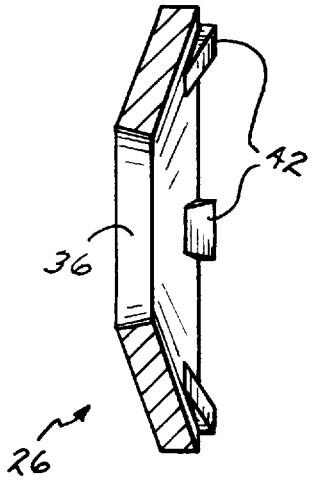
FIG. 5A is a cross-sectional view taken along the line 5A—5A of FIG. 5.

FIG. 5 illustrates a bottom plan view of the washer 26 of the present invention having a circular perimeter and a centrally located hole 36 therein. As best illustrated in FIG. 5A, the washer has a plurality of projections 42 around the exterior thereof and is concavely shaped in cross-section. The projections 42 extend downwardly from the concave surface of the washer and although the washer itself is not of a hardened metal, the projections may be somewhat hardened in order to better penetrate the paint or insulation layer of the sheets of metal.

Figure 6:
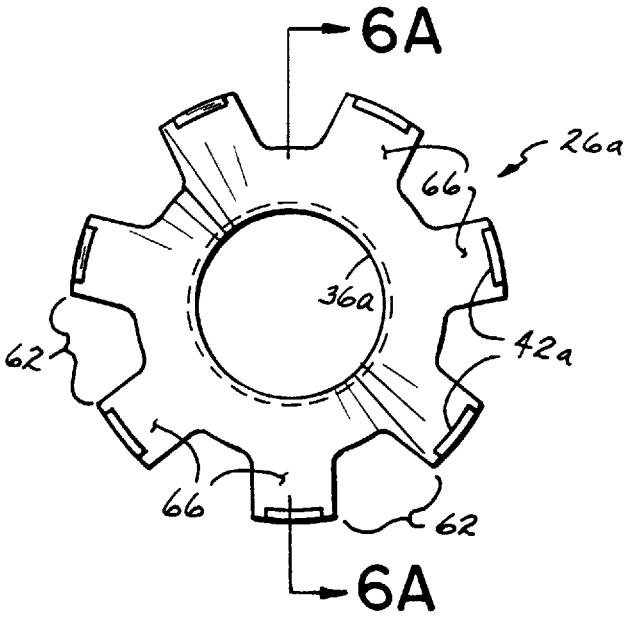
FIG. 6 is bottom view of an alternative embodiment of the washer of FIG. 5.
Figure 6A:
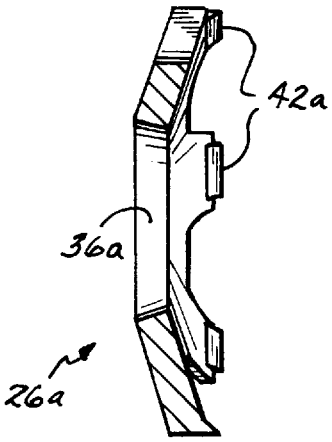
FIG. 6A is a cross-sectional view taken along the line 6A—6A of FIG. 6.

An alternative embodiment of the washer 26 is shown in FIGS. 6 and 6A. This alternative washer 26*a* has portions of the washer removed along the perimeter of the washer. The periphery of the washer 26*a* of this alternative embodiment is not circular, but rather has an irregular shape. A plurality of areas 62 are cut out between extensions 66 of the washer. When compared to the washer of FIG. 5, this alternative washer is made of less metal and therefore is cheaper to mass produce. As with the washer 26 of FIG. a plurality of projections 42*a* extend downwardly from the peripheral edge of the washer, the projections 42*a* being located at the periphery of the extensions 66.

Those skilled in the art will appreciate changes and modifications which may be made without departing from the spirit of the invention. Therefore, we do not intend to be limited except by the scope of the following claims.

What claimed is:

1. An electrically operated device comprising at least one piece of metal coated with an electrically insulative coating and a fastening assembly for establishing both a mechanical and electrical connection to the piece of metal, said fastening assembly including:

a fastener engaged with the piece of metal to establish said mechanical connection therewith; and a washer disposed between at least a portion of said fastener and the piece of metal, said washer having a generally concave side and having a plurality of projections on the generally concave side of said washer, said washer being compressible between said fastener and said piece of metal upon securement of said fastener with said piece of metal thereby causing the projections of said washer to be urged downwardly and move radially outward through said coating to make electrical contact with the piece of metal and form a buildup of coating material on said projections, said washer further being formed of a permanently deformable metal so that upon removal of said fastener said washer remains flattened and mechanically connected against said piece of metal by said build-up of coating material.

2. The device of claim 1 wherein the fastener is a threaded fastener having a head portion and said head portion engages a convex side of said washer during securement to said piece of metal.

3. The device of claim 2 further comprising an additional piece of metal secured with said fastener assembly, each piece comprising a sheet coated on at least one side with an electrically insulative coating and having first and second aligned holes for receiving said fastener.

4. The device of claim 3 wherein said fastener is a sheet metal screw, the first aligned hole being of a size suitable for firmly engaging threads on the screw and the second aligned hole being larger than said first aligned hole, said washer being disposed about said second aligned hole.

5. The device of claim 2 further comprising a second piece of metal secured to said one piece of metal with said fastener assembly and wherein said fastener assembly further includes a nut threadingly engaging said fastener and a second said washer disposed between said nut and the second piece of metal.

6. A fastener assembly for providing an electrical and mechanical connection with a piece of metal, the fastener assembly comprising:

a fastener engageable with the piece of metal to establish a mechanical connection therewith; and a washer securable between at least a portion of said fastener and the piece of metal, said washer having a generally concave side and having a plurality of projections on the generally concave side, said washer being compressible between said fastener and said piece of metal upon securement of said fastener with said piece of metal thereby causing the projections of said washer to be urged downwardly and move radially outward through said coating to make electrical contact with the piece of metal, said washer further being formed of a permanently deformable metal so that tightening said fastener against said washer completely flattens said washer and urges the teeth completely through said coating.

7. The assembly of claim 6 wherein the fastener is a threaded fastener having a head portion and said head portion engages a convex side of said washer during securement to said piece of metal.

8. The assembly of claim 7 wherein said fastener is a sheet metal screw.

9. The device of claim 7 wherein said fastener assembly further includes a nut threadingly engaging said fastener and a second said washer for disposition between said nut and a second piece of metal.

10. A method of securing a washer to a piece of metal having an electrically insulative coating wherein said washer is formed of a permanently deformable material and includes a generally concave side with a plurality of projections, the method comprising the steps of:

inserting said fastener through said washer with the generally concave side of said washer facing the coating; and permanently deforming said washer against said piece of metal with said fastener to cause said projections to penetrate the coating and contact the piece of metal.

11. The method of claim 10 further comprising the step of:

removing said fastener from said washer whereby said washer remains permanently deformed against said piece of metal and mechanically connected to said piece of metal by a build-up of said coating on said projections.

* * * * *

UNITED STATES PATENT AND TRADEMARK OFFICE

CERTIFICATE OF CORRECTION

PATENT NO. : 5,828,008

DATED : October 27, 1998

INVENTOR(S) : Mark D. Lockwood et al.

It is certified that error appears in the above-identified patent and that said Letters Patent is hereby corrected as shown below:

On the title page, in the Abstract:

At [57], lines 4 and 7, change "flattened" to --deformed--.

Column 3, line 49, change "across-sectional" to --a cross-sectional-.

Column 6, line 32, after "FIG." insert --5--.

Claim 6, column 7, line 21, change "a" to --said--.

Claim 9, column 8, line 1, change "device" to --assembly-- and delete "wherein said fastener assembly"; and line 2, change "includes" to --including--.

Signed and Sealed this

Twenty-third Day of March, 1999

*Attest:*

Q. TODD DICKINSON

*Attesting Officer*

*Acting Commissioner of Patents and Trademarks*